US008033019B2

(12) United States Patent
Peffley et al.

(10) Patent No.: US 8,033,019 B2
(45) Date of Patent: Oct. 11, 2011

(54) THREE-PIECE LOWER MANIFOLD FOR A V-STYLE ENGINE INTAKE MANIFOLD

(75) Inventors: Thomas R. Peffley, Penfield, NY (US); Keith A. Confer, Flushing, MI (US); Debra L. Benson, Penfield, NY (US)

(73) Assignee: Delphi Technologies, Inc., Troy, MI (US)

( * ) Notice: Subject to any disclaimer, the term of this patent is extended or adjusted under 35 U.S.C. 154(b) by 1093 days.

(21) Appl. No.: 11/820,635

(22) Filed: Jun. 20, 2007

(65) Prior Publication Data

US 2008/0313904 A1 Dec. 25, 2008

(51) Int. Cl.
*B21D 51/16* (2006.01)
*F02M 35/10* (2006.01)

(52) U.S. Cl. ..... 29/890.08; 123/184.34

(58) Field of Classification Search ..... 29/890.08; 123/184.31–184.37

See application file for complete search history.

(56) References Cited

U.S. PATENT DOCUMENTS 3,520,284 A * 7/1970 Jantschke et al. ..... 123/184.34
4,889,083 A * 12/1989 Honma et al. ..... 123/184.34
5,003,932 A * 4/1991 Duncan ..... 123/184.34
5,016,578 A * 5/1991 Ogawa et al. ..... 123/184.34
5,022,355 A * 6/1991 Billingsley et al. ..... 123/184.39
5,035,211 A * 7/1991 Mate et al. ..... 123/198 E
5,636,605 A * 6/1997 Nomizo et al. ..... 123/184.61
5,743,011 A * 4/1998 Dickerson et al. ..... 29/888.01
6,363,900 B1 * 4/2002 Homi et al. ..... 123/184.21
6,622,682 B2 * 9/2003 Ikuma et al. ..... 123/184.34
6,679,215 B2 * 1/2004 Benson et al. ..... 123/184.34
2005/0005890 A1 * 1/2005 Asfaw et al. ..... 123/184.61

* cited by examiner

*Primary Examiner* — David Bryant
*Assistant Examiner* — Jacob Cigna
(74) *Attorney, Agent, or Firm* — Thomas N. Twomey

(57) ABSTRACT

A lower manifold for a V-style internal combustion engine comprising at least three shells: a top shell for mating with an upper manifold; a left shell for mating with a left engine head; and a right shell for mating with a right engine head. The three shells are formed independently by injection molding and are joined as by vibration welding when aligned in a welding jig. The molds for the left and right shells are formed such that the seal ring groove has a rectangular cross-section having sidewalls perpendicular to the lower shell surface because each left and right shell has its own draft angle preferably perpendicular to its lower shell surface. The method and apparatus of the invention permits runner cross-sections to be significantly rounded, which improves air flow characteristics of the runners.

10 Claims, 2 Drawing Sheets

THREE-PIECE LOWER MANIFOLD FOR A V-STYLE ENGINE INTAKE MANIFOLD

TECHNICAL FIELD

The present invention relates to molded polymer intake manifolds for internal combustion engines; more particularly, to a multiple-part injection molded intake manifold; and most particularly, to a three-piece injection molded intake manifold wherein the walls of a seal groove are parallel to each other and are perpendicular to a mating engine head surface, and wherein the parts may be formed and die drafted without the use of auxiliary slides.

BACKGROUND OF THE INVENTION

Intake manifolds formed by injection molding of polymers are well known in the engine arts. A manifold assembly typically comprises an upper manifold, containing the air entry and control apparatus and an air plenum, and a lower manifold, containing individual runners for supplying air distributed from the upper manifold to the individual intake valve ports in the engine head. The upper and lower manifolds typically are formed separately and are joined as by vibration welding prior to being assembled to an engine. A lower manifold typically is further manufactured by injection molding of a top shell and a bottom shell which are subsequently joined as by vibration welding.

In forming a lower manifold for a V-style engine, a serious manufacturing problem is encountered, which problem is solved by the present invention. In the prior art, the bottom shell is formed as a single unit having a die draft direction that must be along the vertical axis of the shell in order for the mold to exit both left and right banks of the runners. Such a lower manifold is said to be of "two-piece" construction (upper and lower shells). The required die draft direction and split core mold construction restricts the individual runners to substantially rectangular cross-sections which shape is sub-optimal for air delivery and fuel/air mixing.

Further, in order to avoid the use of auxiliary molding slides, which can result in significant increases in cost, molding cycle time, and risk in a productive environment, the seal groove in the manifold face that mates with an engine head must be formed with divergent walls to permit removal of the part from the mold. This groove geometry is not optimal because a ring seal is not reliably retained in the groove during engine assembly without resort to adhesives or mechanical retention devices. Optimally, the groove walls are parallel to each other and perpendicular to the mating faces of the manifold and the engine head to spontaneously retain a seal ring during engine assembly, but such grooves cannot be formed by die drafting along the shell axis without use of an auxiliary molding slide.

What is needed in the art is a method and apparatus of forming a lower shell for a V-style intake manifold wherein the seal groove walls are parallel to each other and perpendicular to the mating faces of the manifold and the engine head without use of an auxiliary molding slide.

It is a principal object of the present invention to provide a lower shell for a V-style intake manifold wherein the seal groove walls are parallel to each other and perpendicular to the mating faces of the manifold and the engine head.

SUMMARY OF THE INVENTION

Briefly described, a lower manifold for a V-style internal combustion engine comprises at least three shells: a top shell for mating with an upper manifold; a left shell for mating with a left engine head; and a right shell for mating with a right engine head. Prior art lower manifolds are formed in two pieces comprising a top shell and a bottom shell. In the present invention, the three shells are formed independently by injection molding and are joined as by vibration welding when aligned in a welding jig. The molds for the left and right shells are formed such that the seal ring groove has a rectangular cross-section having sidewalls perpendicular to the lower shell surface because each left and right shell has its own draft angle perpendicular to its lower shell surface. The method and apparatus of the invention permits runner cross-sections to be significantly rounded, which improves air flow characteristics of the runners.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate preferred embodiments of the invention, and such exemplifications are not to be construed as limiting the scope of the invention in any manner.

DESCRIPTION OF THE PREFERRED EMBODIMENTS

An improved apparatus and method in accordance with the invention for forming an injection-molded lower intake manifold can be better appreciated by first considering a prior art apparatus and method.

Figure 1:
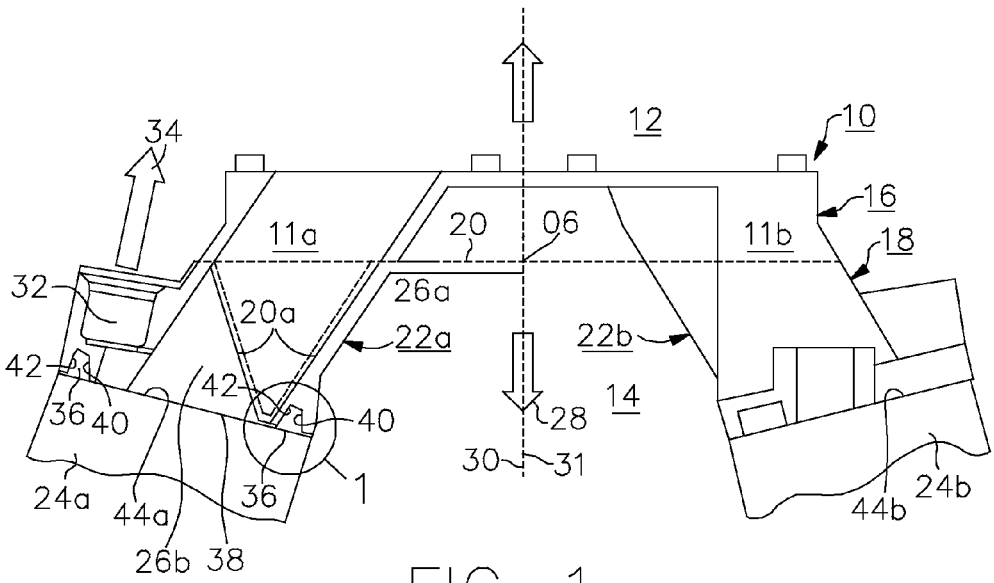
FIG. 1. (PRIOR ART)
FIG. 1 is an elevational cross-sectional view of a prior art lower manifold showing two-piece construction.

Referring to FIG. 1, a prior art lower intake manifold 10 is formed for joining to an upper intake manifold 12 for a V-style internal combustion engine 14. Longitudinal axis 06 of engine 14 runs parallel to the longitudinal axis of rotation of the engine's crank shaft (not shown). Two-piece lower manifold 10 comprises a top shell 16 and a bottom shell 18 joinable along a weld line 20, formed as by vibration welding, and having left and right bottom shell portions 22*a*,22*b* for mating with left and right engine heads 24*a*,24*b*, respectively. Lower manifold 10 includes a plurality of runners 11*a*,11*b* for distributing air from upper manifold 12 to individual ports (not shown) in cylinder heads 24*a*,24*b*, respectively. Note that FIG. 1 shows a cross-sectional view for left portion 22*a* and an end view for right portion 22*b*, allowing display of weld line portion 20*a* which joins interlocking portions 26*a*,26*b* of top shell 16 and bottom shell 18, respectively. Similar weld lines should be understood within right shell portion 22*b* which is substantially a functional mirror image of left shell portion 22*a*. It will be seen that such geometry is a requirement for forming bottom shell 18 as a single component comprising left and right portions 22*a*,22*b* that must be removed from its mold by drawing the mold in direction 28 along centerline 30 which falls within a vertical plane of symmetry 31 of said engine. (Note further that pocket 32 for insertion of a fuel injector is formed in top shell 16 by a separate mold element that is drawn in direction 34 and need not be considered further in the present discussion and disclosure.)

A groove 36 is formed in shell mating surface 38 for retaining a seal ring (not shown) to form a gasket around each runner 11*a*,11*b* between manifold portion 22*a*,22*b* and engine head 24*a*,24*b*. As noted above, an unwanted consequence of having to draw the one-piece lower mold in direction 28 is that groove wall 40 must be formed parallel to direction 28. As seen specifically in circle 1, because the opposing groove wall 42 is formed preferably orthogonal to surface 44*a* of head 24*a*, the resulting groove 36 has undesirably non-parallel, divergent walls in the longitudinal direction of lower manifold 10 (although the groove walls obviously may be mutually parallel and orthogonal to the surface 44*a* in the manifold-transverse direction).

Figure 2:
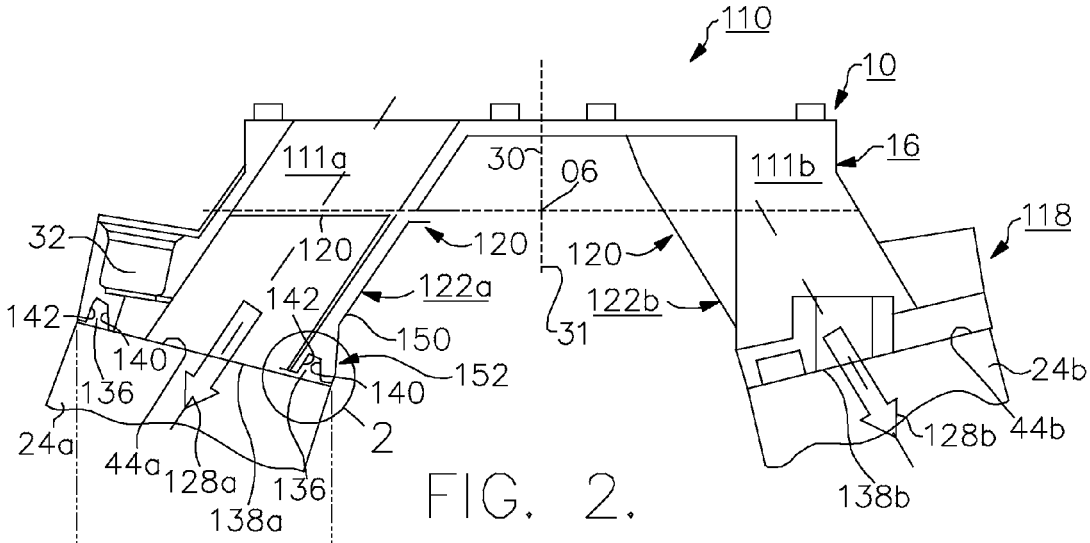
FIG. 2 is an elevational cross-sectional view of a first embodiment of a lower manifold formed in accordance with the invention, showing three-piece construction and improved die draft angle.
Figure 2A:
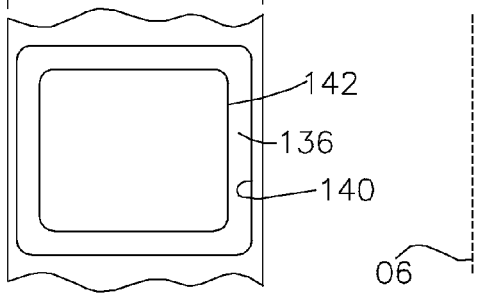
FIG. 2A is a projection of a seal groove of the lower manifold of FIG. 2.

Referring now to FIGS. 2 and 2A, a first embodiment 118 of a two-piece bottom shell for joining to prior art top shell 16 to form a lower manifold 110 in accordance with the invention comprises independently-formed left and right portions 122*a*,122*b*. By separating the left and right portions, the prior art drafting direction 28 is obviated, and the mold for each portion may be constructed such that the mold may be drawn at any desired angle from the vertical plane of symmetry 31 of engine 14 that is not coincidental with vertical plane 31, for example, along the runner centerline direction 128*a*,128*b* of each portion 122*a*,122*b*. (Note: the runner centerlines for all of the runners in either of left and right portions 122*a*,122*b* or in embodiment 210 preferably are all contained in a runner centerline plane of each portion.) This eliminates the need for the prior art interlocking portions 26*a*,26*b*, permitting a planar weld 120 across the entire assembly. The top shell 16 and bottom shell portions 122*a*,122*b* are positioned and held in a precision welding jig (not shown, but in known fashion) to facilitate precise alignment of mating edges in the runners 111*a*,111*b*.

As seen specifically in circle 2, drafting in centerline direction 128*a*,128*b* permits a seal groove 136 having desirably parallel walls 140,142 which also are parallel to direction 128*a*,128*b*. However, undesirably, the walls are not perpendicular to either shell surfaces 138*a*, 138*b* or head surfaces 44*a*, 44*b*. Further, forming the portion shown in circle 2 undesirably requires use of an additional slide (not shown) in molding because a fixed mold portion forming surface 150 cannot be drawn past the enlarged shell portion 152 shown in circle 2.

Figure 3:
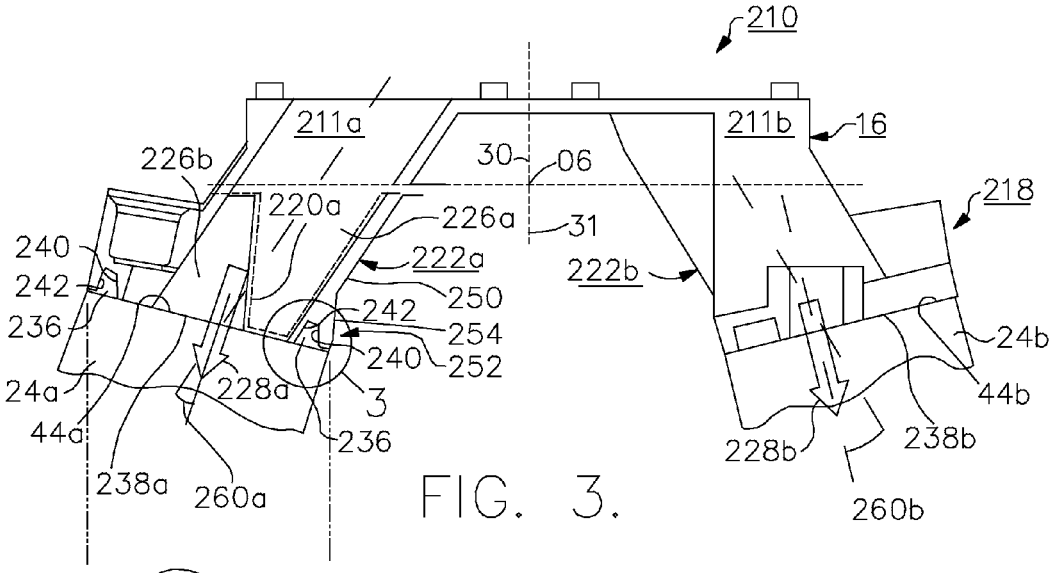
FIG. 3 is an elevational cross-sectional view of a second and preferred embodiment of a three-piece lower manifold formed in accordance with the invention.
Figure 3A:
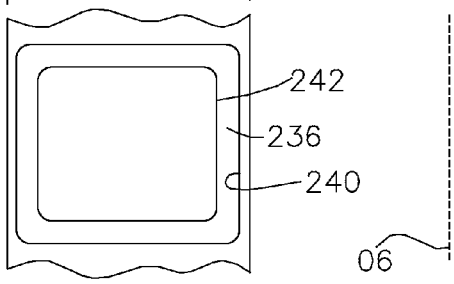
FIG. 3A is a projection of a seal groove of the lower manifold of FIG. 3.

Referring to FIGS. 3 and 3A, a second embodiment 218 of a two-piece bottom shell for joining to prior art top shell 16 to form a lower manifold 210 in accordance with the invention comprises independently-formed left and right portions 222*a*,222*b*. By separating the left and right portions, the prior art drafting direction 28 again is obviated, and the mold for each portion may be constructed such that the mold may be drawn along a direction 228*a*,228*b* of each portion 222*a*, 222*b*, which direction is orthogonal to shell mating surface 238*a* of portion 222*a* and surface 44*a* of left head 24*a*, and further at an angle 260*a*,260*b* to runner centerline direction 128*a*,128*b*. This again creates a need for interlocking portions 226*a*,226*b* that meet along a weld line lying in a plane 220*a* disposed at an angle between direction 228*a* and centerline 30. The top shell 16 and bottom shell portions 222*a*,222*b* are positioned and held in a precision welding jig (not shown, but in known fashion) to facilitate precise alignment of mating edges in the runners 211*a*,211*b*.

As seen specifically in circle 3, drafting in direction 228*a*, 228*b* permits a seal groove 236 having desirably parallel walls 240,242 parallel to direction 228*a*,228*b*. Further, the walls are perpendicular to both of shell surface 238*a* and head surface 44*a*. Further, forming the portion shown in circle 3 does not require an additional slide in molding because a fixed mold portion forming surface 250 can be drawn past the enlarged portion 252 having a surface 254 parallel to direction 228*a*.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An injection mold for forming a first lower shell of a lower intake manifold for an internal combustion engine having first and second cylinder banks, the lower intake manifold having first and second banks of runners and having a seal groove surrounding each of the runners in a mating face of the lower intake manifold to the engine head, the seal grooves having first and second sidewalls extending over a portion of their length in a direction parallel to a longitudinal axis of the engine, the first bank of runners having axes contained in a first plane and the second bank of runners having axes contained in a second plane, the injection mold comprising first and second molding elements, wherein each of said first and second molding elements defines a respective portion of each of said runners of said first lower shell, wherein said first and second molding elements meet within said runners along a plane formed at a first angle to said first plane of said runners, and wherein said first plane of said runners forms a second angle with a vertical plane of symmetry through said engine, and wherein after injection of thermoplastic material to form said first lower shell said second molding element is pulled from said first molding element in a direction contained within said second angle but not coincident with said vertical plane of symmetry.

2. A method for forming a lower intake manifold for mating with first and second heads of an internal combustion engine having first and second cylinder banks, the lower intake manifold having first and second banks of runners and having a seal groove surrounding each of the runners in a mating face of the lower intake manifold to the engine head, the seal grooves having first and second sidewalls extending over a portion of their length in a direction parallel to a longitudinal axis of the engine, the first bank of runners having axes contained in a first plane and the second bank of runners having axes contained in a second plane, comprising the steps of:

a) forming an upper shell having first and second upper portions of said first and second banks of runners respectively for mating with an upper intake manifold;

b) forming a first lower shell having lower portions of said first bank of runners for mating with said first upper portion of said upper shell;

c) forming a second lower shell having lower portions of said second bank of runners for mating with said second upper portion of said upper shell; and d) joining said first lower shell and said second lower shell to said upper shell to form said lower intake manifold, wherein at least one of said first and second sidewalls is orthogonal to said mating face of said lower intake manifold.

3. A method for forming a lower intake manifold for mating with first and second heads of an internal combustion engine having first and second cylinder banks, wherein the lower intake manifold has first and second banks of runners and has a seal groove surrounding each of the runners in a mating face of the lower intake manifold to the engine head, comprising the steps of:

a) forming an upper shell having first and second upper portions of said first and second banks of runners respectively for mating with an upper intake manifold;

b) forming a first lower shell having lower portions of said first bank of runners for mating with said first portion of said upper shell;

c) forming a second lower shell having lower portions of said second bank of runners for mating with said second portion of said upper shell; and d) joining said first lower shell and said second lower shell to said first and second upper portions respectively of said upper shell to form said lower intake manifold;

wherein said seal grooves have first and second sidewalls extending over a portion of their length in a direction parallel to a longitudinal axis of the engine, and wherein said first bank of runners has runner axes contained in a first plane and said second bank of runners has runner axes contained in a second plane, wherein said step of forming a first lower shell includes the step of providing a two-element injection mold comprising first and second molding elements, wherein each of said first and second molding elements defines a respective portion of each of said runners of said first lower shell, wherein said first and second molding elements meet within said runners along a plane formed at a first angle to said first plane of said runners, wherein said first plane of said runners forms a second angle with a vertical plane of symmetry through said engine, and wherein after injection of thermoplastic material to form said first lower shell said second molding element is pulled from said first molding element in a direction contained within said second angle but not coincident with said vertical plane of symmetry through said engine.

4. A method in accordance with claim 3 wherein at least one of said first and second sidewalls is orthogonal to said mating face of said lower intake manifold.

5. A method in accordance with claim 3 wherein both of said first and second seal groove sidewalls are orthogonal to said mating face of said lower intake manifold.

6. A method in accordance with claim 3 wherein said second molding element further includes a slider to permit removal of said first lower shell from said two-element injection mold.

7. A method in accordance with claim 3 comprising the further steps of:

a) injecting a thermoplastic material into said two-element injection mold having a first molding element and a second molding element for said first lower shell to form said first lower shell; and b) drawing said second molding element from said first molding element in a direction contained within said second angle but not coincident with said vertical plane of symmetry through said engine.

8. A method in accordance with claim 7 wherein said direction is coincident with said runner axes.

9. A method in accordance with claim 3 wherein at least one of said first and second seal groove sidewalls extending over a portion of their length in a direction parallel to the longitudinal axis of said engine is parallel to said first plane of said runners.

10. A method in accordance with claim 9 wherein both of said first and second seal groove sidewalls extending over a portion of their length in a direction parallel to the longitudinal axis of said engine is parallel to said first plane of said runners.

* * * * *